US006314831B2

(12) United States Patent
Rixon et al.

(10) Patent No.: US 6,314,831 B2
(45) Date of Patent: Nov. 13, 2001

(54) ADJUSTABLE PEDAL-PARALLEL SCREW AND ROD

(75) Inventors: Christopher J. Rixon, Tecumseh (CA); Christopher Bortolon, Clawson, MI (US)

(73) Assignee: Teleflex Incorporated, Plymouth Meeting, PA (US)

( * ) Notice: Subject to any disclaimer, the term of this patent is extended or adjusted under 35 U.S.C. 154(b) by 0 days.

(21) Appl. No.: 09/379,778

(22) Filed: Aug. 24, 1999

(51) Int. Cl.[7] ..... G05G 1/14
(52) U.S. Cl. ..... 74/512; 74/560
(58) Field of Search ..... 74/512, 513, 560, 74/522; 180/315, 334

(56) References Cited

U.S. PATENT DOCUMENTS

| | | | | |
|---|---|---|---|---|
| 3,288,239 | * | 11/1966 | Ristau | 74/513 |
| 3,359,821 | | 12/1967 | Beardsley et al. | 74/471 |
| 3,643,524 | * | 2/1972 | Herring | 74/513 |
| 3,643,525 | * | 2/1972 | Gibas | 74/513 |
| 4,312,246 | * | 1/1982 | Barresi | 74/512 |
| 4,870,871 | * | 10/1989 | Ivan | 74/513 |
| 4,875,385 | * | 10/1989 | Sitrin | 74/513 |
| 4,903,936 | | 2/1990 | Kajiwara | 251/14 |
| 4,989,474 | | 2/1991 | Cicotte et al. | 74/512 |
| 5,078,024 | | 1/1992 | Cicotte et al. | 74/512 |
| 5,460,061 | | 10/1995 | Redding et al. | 74/512 |
| 5,697,260 | | 12/1997 | Rixon et al. | 74/512 |
| 5,722,302 | | 3/1998 | Rixon et al. | 74/514 |
| 5,819,593 | | 10/1998 | Rixon et al. | 74/514 |
| 5,996,438 | * | 12/1999 | Elton | 74/512 |
| 6,151,985 | * | 11/2000 | Garber et al. | 74/512 |

FOREIGN PATENT DOCUMENTS

| | | | | |
|---|---|---|---|---|
| 920784 | * | 3/1963 | (GB) | 74/512 |
| 59-67145 A | * | 4/1984 | (JP) | 74/512 |
| 61-11836 A | * | 1/1986 | (JP) | 74/512 |
| 2-116911 A | * | 5/1990 | (JP) | 74/512 |

* cited by examiner

*Primary Examiner*—Allan D. Herrmann
*Assistant Examiner*—Chong H. Kim
(74) *Attorney, Agent, or Firm*—Howard & Howard

(57) ABSTRACT

Various adjustable pedal assemblies (10, 110 and 210) include a pedal support (16, 116 or 216) slidably supported on a guide rod (12) with a pedal lever (18, 118 or 218) mounted on the support (16, 116 or 216) along the guide rod (12). The adjustable pedal assemblies (10, 110 and 210) are characterized by the screw (22) being external to and parallel to the guide rod (12). In the embodiment of FIGS. 1 and 2, the pedal lever (18 or 118) is pivotally attached to the support (16 or 116) whereas in the embodiment of FIG. 3, the pedal lever (218) and the support (216) are defined by an integral member and the bracket (214) includes a connection (34) for rotatably supporting the bracket (214) on a vehicle.

11 Claims, 3 Drawing Sheets

ADJUSTABLE PEDAL-PARALLEL SCREW AND ROD

BACKGROUND OF THE INVENTION

1. Technical Field

The subject invention relates to an adjustable pedal assembly of the type attached to an automotive vehicle to control the brake, clutch and/or throttle in normal operation but which can be adjusted to a different position to accommodate a different driver position.

2. Description of the Prior Art

Foot operated pedals are provided for controlling the brakes, clutch, and engine throttle in automotive vehicles. Pedal assemblies have been recently developed wherein the position of pedal can be adjusted to accommodate different operators and/or driving positions. One group of such assemblies include a guide rod slidably supporting a pedal support with a pedal lever mounted on the support. A screw is included for driving the pedal support along the rod between various adjusted positions. However, the screw is disposed within the guide rod which complicates the drive connection between the pedal support and the screw. Variations of such assemblies are disclosed in U.S. Pat. Nos. 3,643,525; 4,875,385; 4,989,474; 5,078,024; 5,460,061; 5,697,260; 5,722,302 and 5,819,593.

With the constant desire to reduce weight and cost, there remains the corresponding need for simplified combinations to reduce the number of components, the combined weight and the manufacturing operations.

SUMMARY OF THE INVENTION AND ADVANTAGES

An adjustable pedal assembly comprising a guide rod, a pedal support slidably supported on the guide rod, a pedal pivotally mounted on the support, and a screw for driving said pedal support along the rod. The assembly is characterized by the screw being external to and parallel to the guide rod.

The combination of he subject invention reduces the number of components, the combined weight and the manufacturing operations. In a more specific sense, there is no need to bore out the center of the guide rod to insert the screw when the screw is located external to and parallel to the guide rod. This feature allows for a solid guide rod to be used, saving money and time in manufacturing the product.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
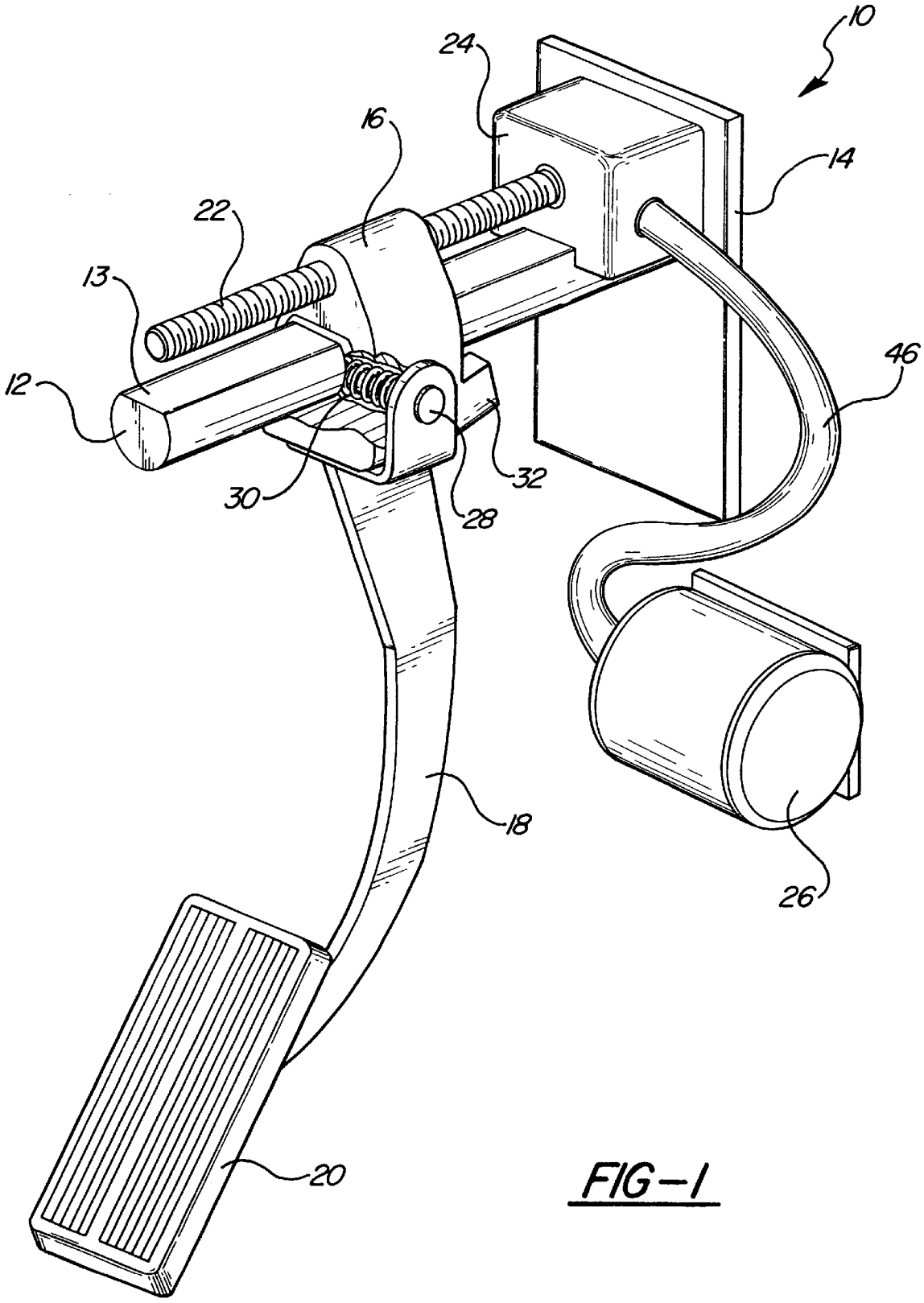
FIG. 1 is a perspective view of a first embodiment.
Figure 2:
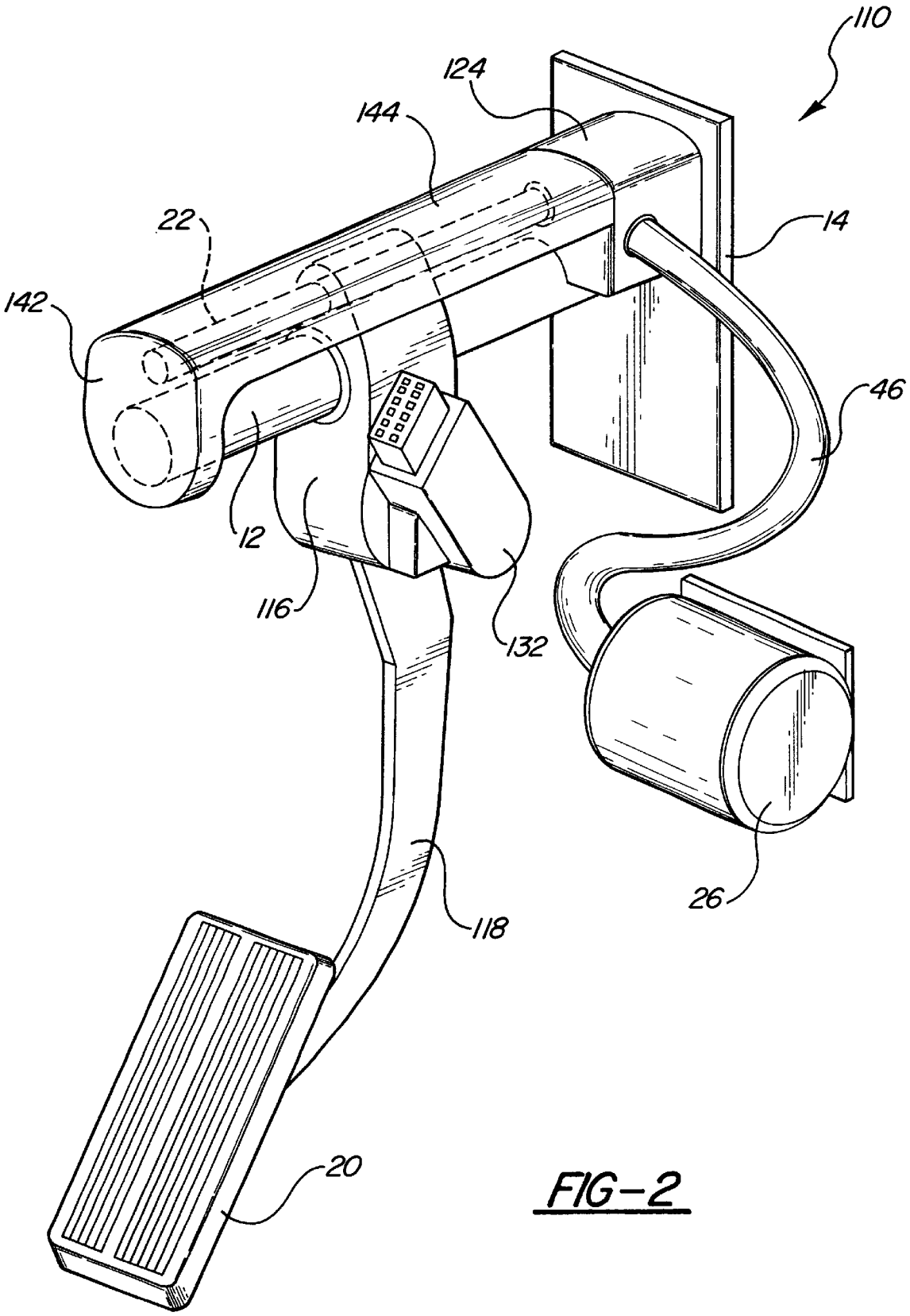
FIG. 2 is a perspective view of a second embodiment.
Figure 3:
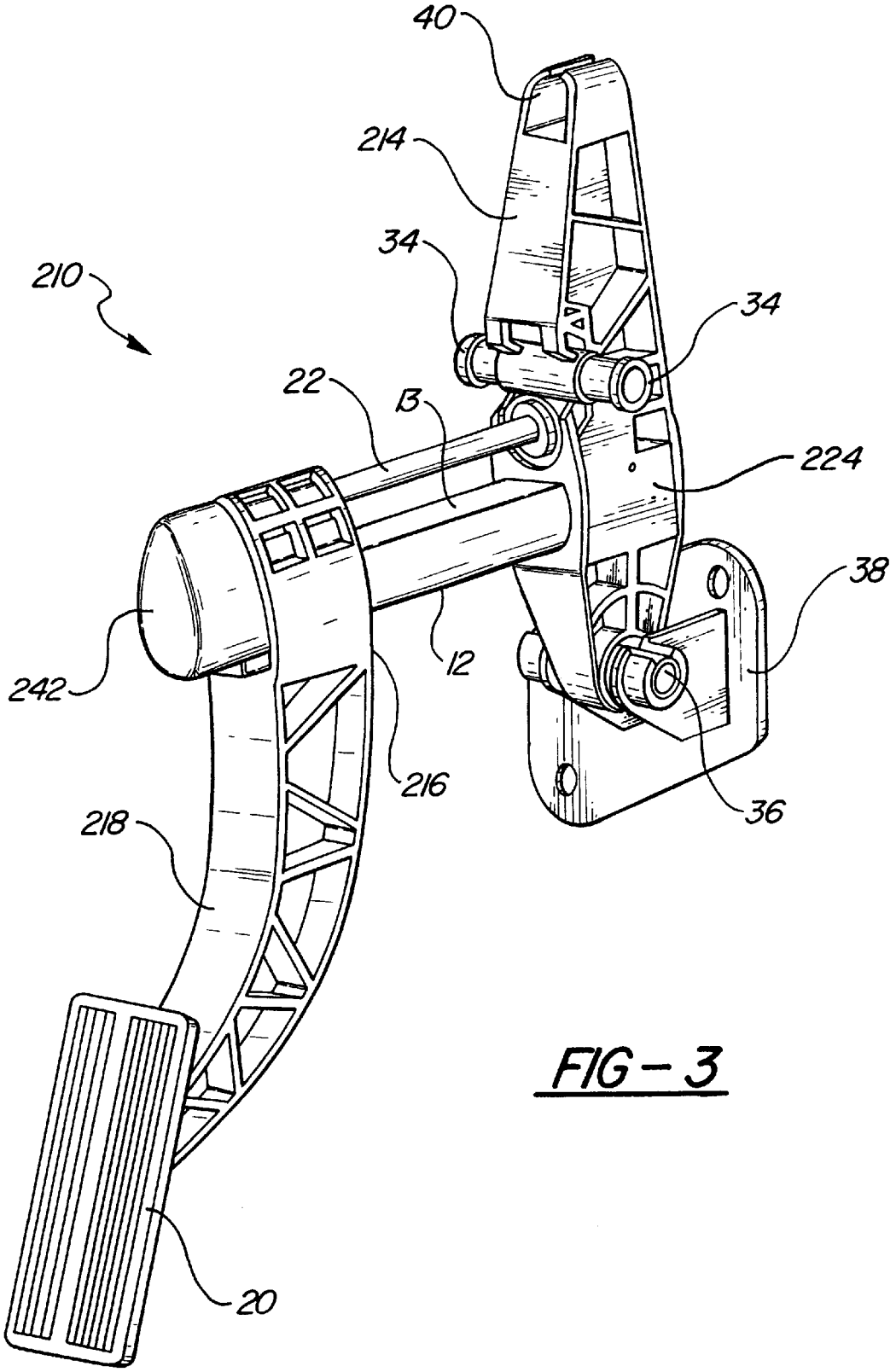
FIG. 3 is a perspective view of a third embodiment.

Referring to the Figures, wherein like numerals or numerals separated by one hundred, indicate like or corresponding parts throughout the several views, an embodiment of an adjustable pedal assembly constructed in accordance with the subject invention is generally shown at 10, 110 and 210, respectively, in FIGS. 1, 2 and 3, respectively.

Each adjustable pedal assembly 10, 110 and 210 includes a guide rod 12. The guide rod 12 in the embodiment of FIGS. 1 and 3 is D-shaped as viewed in cross section to provide a key or flat surface 13. A bracket 14 or 214 is adapted for attachment to the structure of a motor vehicle and the guide rod 12 is fixed to and extends from the bracket 14 or 214.

A pedal support 16, 116 or 216 is slidably supported on the guide rod 12. A pedal lever 18, 118 or 218 is mounted on the support 16, 116 or 216 and includes a pedal pad 20 at its lower distal end. A screw 22 extends from the bracket 14 or 214 for driving the pedal support 16, 116 or 216 along the guide rod 12. The screw 22 threadedly engages the support 16, 116 or 216 whereby the support 16, 116 or 216 moves along the guide rod 12 in response to rotation of the screw 22. A drive mechanism 24, 124 or 224 for rotating the screw 22 comprises a gear box which may be driven by an electric motor 26. In the embodiment of FIGS. 1 and 2, the drive mechanism 24 or 124 is disposed on the guide rod 12 adjacent the bracket 14, i.e., the drive mechanism 24 or 124 is secured to both the guide rod 12 and the bracket 14. However, in the embodiment of FIG. 3, the bracket 214 is defined by a housing and the drive mechanism 224 is disposed in the housing of the bracket 214, (the motor not being shown in FIG. 3).

The adjustable pedal assemblies 10, 110 and 210 are characterized by the screw 22 being external to and parallel to the guide rod 12. In the embodiment of FIGS. 1 and 2, the pedal lever 18 or 118 is pivotally attached to the support 16 or 116. A pin such as that shown at 28 in FIG. 1 secures the pedal levers 18 and 118 to the respective supports 16 and 116. In addition, a torsion spring 30 surrounds the pin 28 to react with the pedal levers 18 and 118 to provide a resistance to pivotal movement thereof. It is important to use a pedal assembly which provides for a hysteresis effect to allow an operator advancing a pedal using foot pressure to have to use greater pressure for pedal advancement than that required to maintain a fixed position. This effect is important in maintaining the pedal in position while driving at a relatively constant speed and it must be considered in achieving a desired deceleration time. The hysteresis effect lessens the load to maintain a setting of the pedal, yet there is still enough force to cause reverse pedal action when a foot applied pressure is removed. The torsion spring 30 provides such a hysteresis effect.

In order to transmit a signal responsive to pivotal movements of the pedal levers 18 and 118, an electrical signal generator 32 or 132 is supported by each of the pedal supports 16 and 116 for generating an electrical signal, which, in turn, controls the brake system or throttle.

On the other hand, the bracket 214 of the embodiment of FIG. 3 includes a connection 36 for rotatably supporting the bracket 214 on a vehicle in response to pivotal movement of the pedal lever. A pin 36 rotatably supports the bracket 214 on the vehicle structure 38. The pedal lever 218 and the support 216 are defined by an integral or one piece plastic member which threadedly engages the screw 22 and is in sliding engagement with the guide rod 12. The integral one piece member extends downwardly from the guide rod 12 to a pedal pad 20 end. The top end of the integral one piece member includes an element connector 40 adapted for connection to an element to be controlled, such as a cable assembly leading to the brake system or throttle.

The screw 22 and the guide rod 12 extend from the brackets 14, 114 and 214 to distal ends. These distal ends are cantilevered or unconnected in the embodiment of FIG. 1 whereas a cap 142 or 242 interconnects the distal ends in the embodiments of FIGS. 2 and 3. In the case of FIG. 2, the cap 142 is integral with a cover 144 which extends between the cap 142 and the drive mechanism 124 or bracket 14. The caps 142 and 242 are secured to the distal ends of the screw 22 and the guide rod 12 to maintain stability and the parallel relationship between the screw 22 and the guide rod 12.

The guide rod 12 extends rigidly rearward from the bracket 14 or 214 and is made of any standard metal. The guide rod 12 can attach either directly to the bracket 14, 114 or 214 or to the drive mechanism 24, 124 or 224 which is fixedly attached to the bracket 14, 114 or 214. The guide rod 12 could be slotted at either end to facilitate attachment to the bracket 14, 114 or 214 or to the bearing caps 142 or 242.

The pedal support 16, 116 or 216 which may be formed as a casting, forging or stamping, and is designed to move slidably along the guide rod 12. Preferably the one piece member defining the pedal lever 218 and the support 216 is molded of an organic polymeric material, which significantly reduces weight.

The drive mechanism 24,124 or 224 may be attached to a motor 26 which can be located at any position within the front of the car so long as a connection 46 can be made to the drive mechanism 24,124 or 224. The motor can be any standard motor which can be activated by an electric signal generated by an operator.

The use of the potentiometer as a signal generator 32 or 132 is an effective manner of generating a signal and such is disclosed in U.S. Pat. No. 5,819,593 which is assigned of the present invention. The signal generator 32 or 132 responds to pedal lever 18, 118 or 218 movement by generating a signal which is used by a corresponding device, such as the vehicle computer and/or the engine controller.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An adjustable pedal assembly comprising;

a guide rod (12), a pedal support (16, 116 or 216) surrounding and slidably supported on said guide rod (12), a pedal lever mounted on said support (16, 116 or 216) for movement in a plane parallel to said rod (12) independent of movement of said pedal support (16, 116, or 216) along said guide rod (12), a screw (22) for driving said pedal support (16, 116 or 216) along said guide rod (12) to adjust the position of said pedal lever in said plane, said adjustable pedal assembly (10, 110 and 210) characterized by said screw (22) being external to and parallel to said guide rod (12), said pedal lever being movable about a pivot, said pivot being independent of said screw whereby said screw is free of loads at said pivot resulting from pivotal movement of said pedal lever about said pivot.

2. An assembly as set forth in claim 1 including a bracket (14 or 214) for attachment to a motor vehicle, said guide rod (12) being fixed to and extending from said bracket (14 or 214).

3. An assembly as set forth in claim 2 wherein said pedal lever is pivotally attached to said support (16 or 116).

4. An assembly as set forth in claim 3 including a signal generator (32 or 132) supported by said pedal support (16 or 116) and responsive to movements of said pedal lever for generating an electrical signal.

5. An assembly as set forth in claim 2 wherein said bracket (214) includes a connection (34) for rotatably supporting said bracket (214) on a vehicle in response to pivotal movement of said pedal lever.

6. An assembly as set forth in claim 5 wherein said pedal lever and said support (216) are defined by an integral member threadedly engaging said screw (22) and in sliding engagement with said guide rod (12) and extending downwardly from said guide rod (12) to a pedal end.

7. An assembly as set forth in claim 2 including a drive mechanism (24, 124 or 224) for rotating said screw (22).

8. An assembly as set forth in claim 7 wherein said drive mechanism (24 or 124) is disposed on said guide rod (12) adjacent said bracket (14).

9. An assembly as set forth in claim 7 wherein said bracket (214) is defined by a housing and said drive mechanism (224) is disposed in said housing of said bracket (214).

10. An assembly as set forth in claim 2 wherein said screw (22) and said guide rod (12) extend from said bracket (142 or 242) to distal ends, and including a cap or (142 or 242) interconnecting said distal ends.

11. An assembly as set forth in claim 1 wherein said guide rod (12) is larger in the transverse direction than said screw (22).

* * * * *